US005711335A

United States Patent [19]

Carpinella

[11] Patent Number: 5,711,335

[45] Date of Patent: Jan. 27, 1998

[54] MEDICAL WALKER FOOT WITH COLLAPSIBLE TIP

[75] Inventor: Ralph Carpinella, Middlebury, Conn.

[73] Assignee: Carpin Manufacturing, Inc., Waterbury, Conn.

[21] Appl. No.: 703,961

[22] Filed: Aug. 28, 1996

[51] Int. Cl.[6] ..... A45B 9/04

[52] U.S. Cl. ..... 135/77; 135/80; 135/81; 135/82; 135/86

[58] Field of Search ..... 135/77, 80, 81, 135/82, 86

[56] References Cited

U.S. PATENT DOCUMENTS

| | | | |
|---|---|---|---|
| 1,334,208 | 3/1920 | Ames | 135/82 X |
| 1,406,453 | 2/1922 | Fannino | 135/86 X |
| 2,371,246 | 3/1945 | McGrory et al. | 135/81 X |
| 3,901,258 | 8/1975 | Montgomery | 135/81 X |
| 4,510,957 | 4/1985 | Frank | 135/86 X |
| 4,977,914 | 12/1990 | Smerker | 135/81 |

*Primary Examiner*—Wynn E. Wood

*Attorney, Agent, or Firm*—Alix, Yale & Ristas, LLP

[57] ABSTRACT

A medical walker foot includes a shell having a base portion for engaging a floor or the ground when weight is applied to the walker and a sleeve portion for receiving the lower end of the medical walker leg. A cup-like urethane cushion is disposed within the shell for biasing a tip member into an extended position, disengaging the base portion from the ground, and allowing the tip member to glide along the ground when weight is removed from the walker. The base portion of the shell includes a wiper seal which extends radially into the opening in the base portion to form a watertight seal with the stem of the tip member.

19 Claims, 5 Drawing Sheets

MEDICAL WALKER FOOT WITH COLLAPSIBLE TIP

BACKGROUND OF THE INVENTION

This invention relates generally to a foot or tip member for a tubular shaft. More particularly, the present invention relates to a tip assembly for the leg of a medical walker.

Medical technology has increased the life expectancy of the average person in the United States. As a consequence, a larger number of persons are attaining an age where they require assistance in performing normal, routine functions. One such form of assistance is provided by medical walkers. Medical walkers allow persons having difficulty in walking to ambulate without the aid of a wheelchair. Traditional medical walkers generally comprise a rail structure that is U-shaped when viewed from above. Four legs extend vertically from the bottom of the rail structure and engage the ground. Typically, a resilient foot is mounted on the distal end of each leg to improve traction on smooth surfaces.

The user grips a tubular upper rail and steps into the walker. The user progresses by repetitively advancing the walker and then stepping into the walker. Each time the walker is advanced, the user must lift the walker such that the feet do not engage the ground, move the walker forward, and place the walker down such that each foot engages the ground. Consequently, the walker does not provide the required support when it is being advanced. In fact, lifting the walker may cause the user to become unbalanced.

SUMMARY OF THE INVENTION

Briefly stated, the invention in a preferred form is a medical walker foot with a collapsible tip which comprises a shell having a base portion for engaging a floor or the ground and a sleeve portion defining a cavity for receiving the lower end of the medical walker leg. The hard, smooth distal tip portion of the retractable tip member resiliently extends beyond the bottom of the base portion when the walker is being positioned, allowing the distal tip portion to glide along the ground. The retractable tip member retracts into the shell when weight is applied to the walker, allowing the bottom of the base portion to engage the ground.

A cushion assembly including a cushion member and a rigid housing is disposed within the shell to bias the distal tip portion of the tip member into the extended position. The housing includes an upper cup-shaped can and a lower washer which are joined along a roll seam. The roll seam forms a retainer shoulder which is engaged by the end of the walker leg for clamping the cushion assembly in place within the shell. The cushion member is a resilient, unitary member in the form of a bowl or cup, with the convex surface facing downward and the concave surface facing upward. A substantially cylindrical rim portion has a free end which rests on the inner surface of the upper portion of the can. The substantially flat, solid, circular lower surface acts as a pedestal bearing surface for the pad of a retractable tip member. A side wall extends between the rim portion and the pedestal surface portion. When weight is applied to the walker, the cushion member resiliently deflects vertically upward allowing the retractable tip member to be pushed into the retracted position.

The retractable tip member is composed of a hard polymeric material and includes an upper pad disposed in the cushion assembly housing and a lower stem which extends downwardly through openings in the washer and the base portion of the shell to a distal tip portion which extends beyond the lower surface of the base portion when the tip member is in the extended position. The base portion of the shell includes a wiper seal which extends radially into the opening in the base portion to form a watertight seal with the stem of the tip member.

An object of the invention is to provide a new and improved foot for a medical walker.

Another object of the invention is to provide a new and improved foot for a medical walker that allows the user to slidably reposition the walker while maintaining contact between the walker and the ground.

Other objects and advantages of the invention will become apparent from the drawings and specification.

BRIEF DESCRIPTION OF THE DRAWING

The present invention may be better understood and its numerous objects and advantages will become apparent to those skilled in the art by reference to the accompanying drawings wherein like numerals represent like parts throughout the several figures, in which.

DETAILED DESCRIPTION OF THE PREFERRED EMBODIMENT

Figure 1:
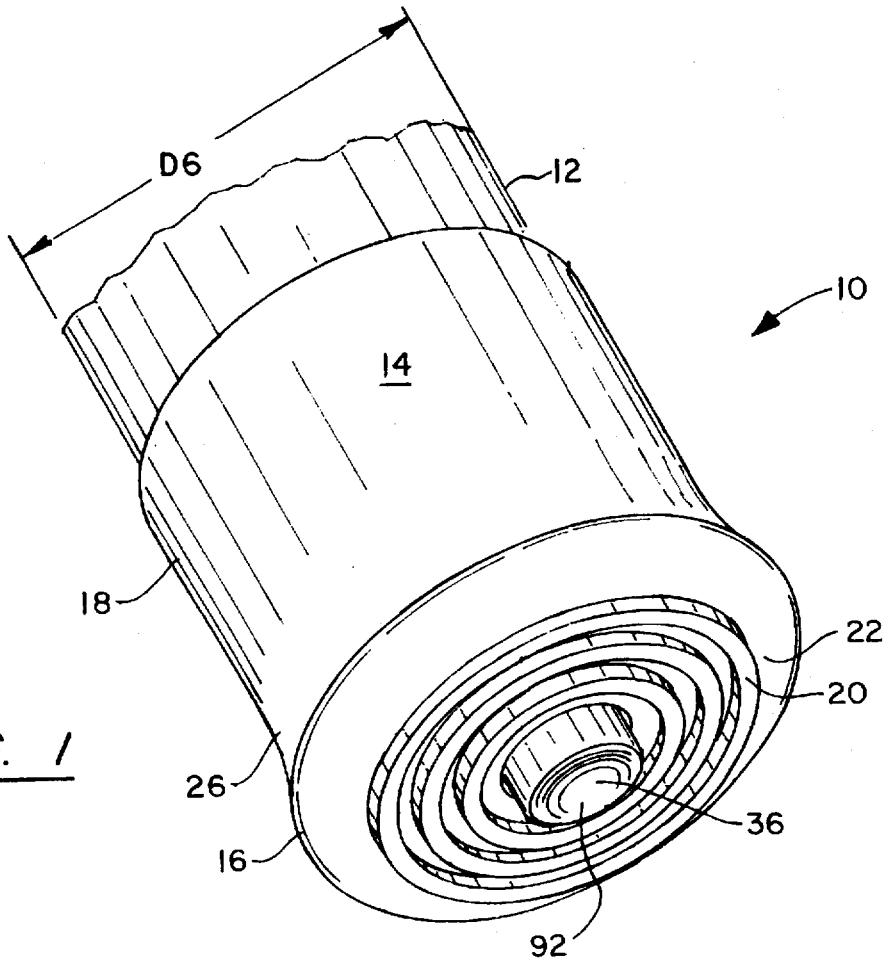
FIG. 1 is a perspective view of a medical walker foot with a collapsible tip in accordance with the invention, mounted on the distal end of a leg of a medical walker.

FIG. 1 shows a combination in which a foot 10 having a collapsible tip in accordance with the invention is associated with the lower end of a leg 12 of a medical walker, the foot 10 and leg 12 being joined at an assembly station in a factory.

The foot 10 comprises a shell 14 having a base portion 16 for engaging a floor or the ground and a sleeve portion 18 for receiving the lower end of the medical walker leg 12. In a preferred embodiment, the shell 14 is composed of a resilient material. The inside diameter D5 (FIG. 3) of the sleeve portion 18 is selected such that D5 is slightly smaller than the outside diameter D6 of the leg 12. Therefore, the sleeve portion 18 is stretched slightly during installation, causing the sleeve portion 18 to clamp the walker leg 12 within the foot 10. A plurality of ribs 20 extend from the bottom surface 22 of the base portion 16. The ribs 20 elastically deform to conform closely to the surface of the floor or ground when the user pushes down on the medical walker. Such deformation facilitates engagement between the foot 10 and the floor or ground, thereby minimizing the possibility that the foot 10 will skid along the surface. Preferably, the outer surface 24 of the distal end 26 of the sleeve portion 18 is angled obliquely outwardly to provide an increased wall thickness. Such increased wall thickness reduces the flexibility of the distal end 26.

Figure 2:
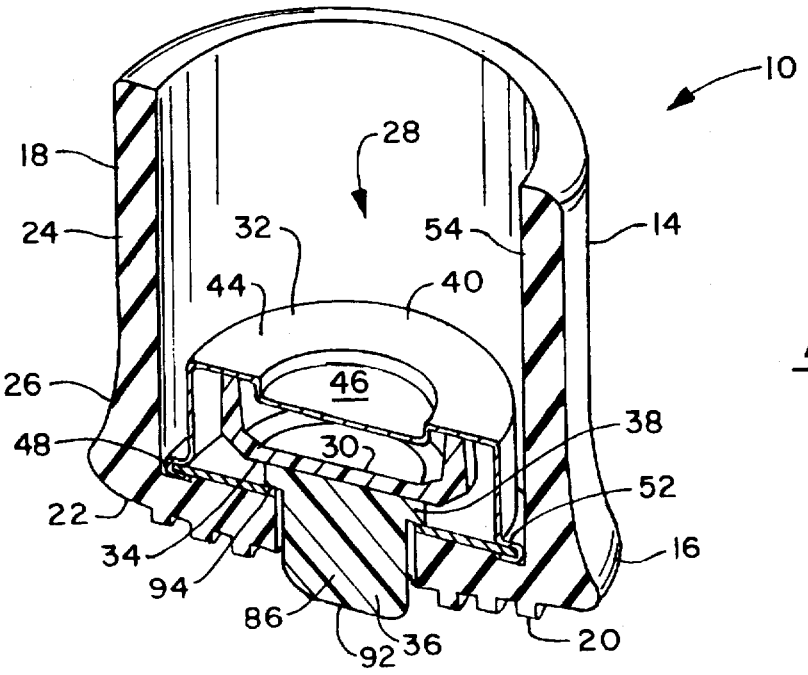
FIG. 2 is section view of the medical walker foot of FIG. 1.
Figure 3:
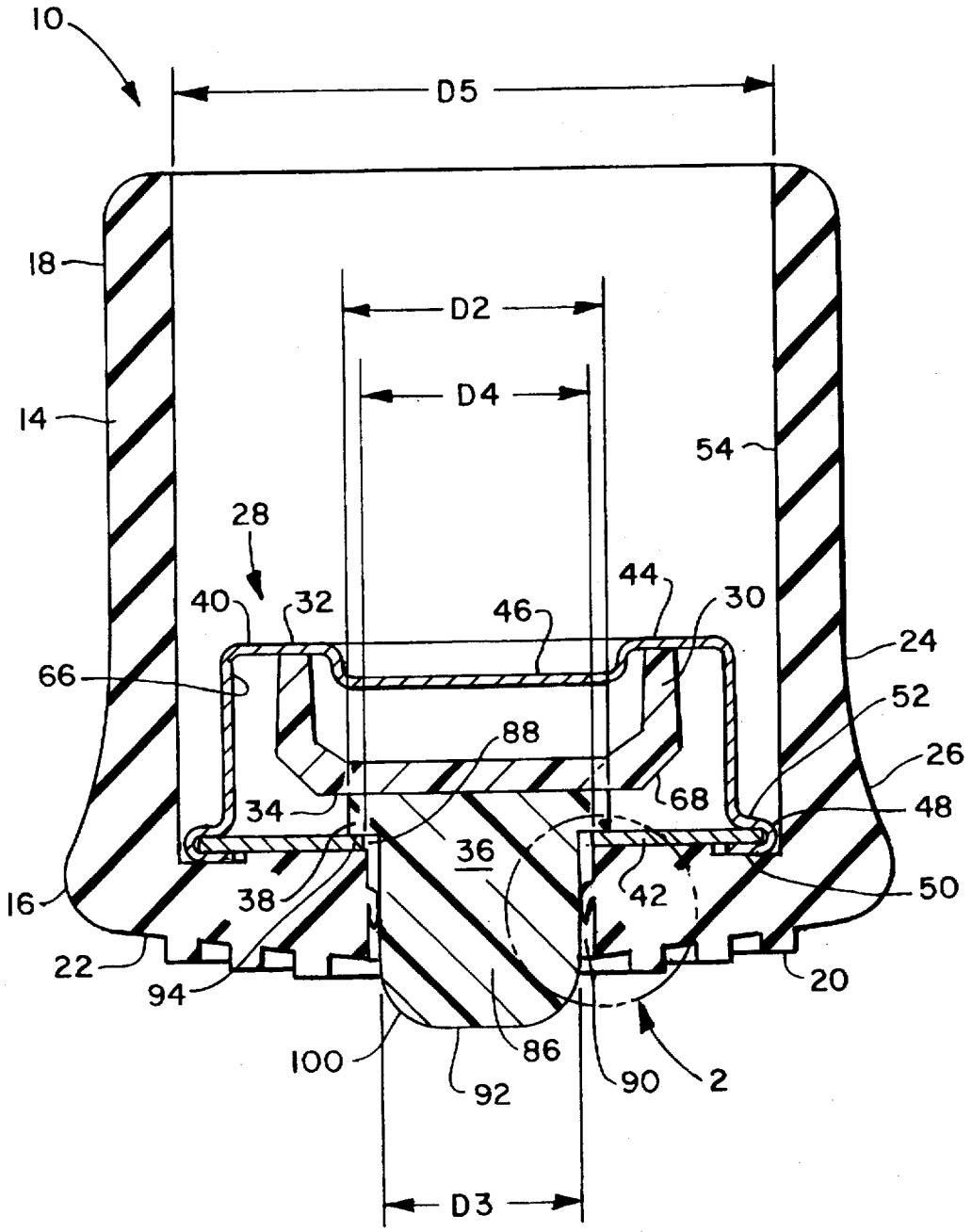
FIG. 3 is an enlarged section view of the medical walker foot of FIG. 1 showing the tip in the extended position.
Figure 4:
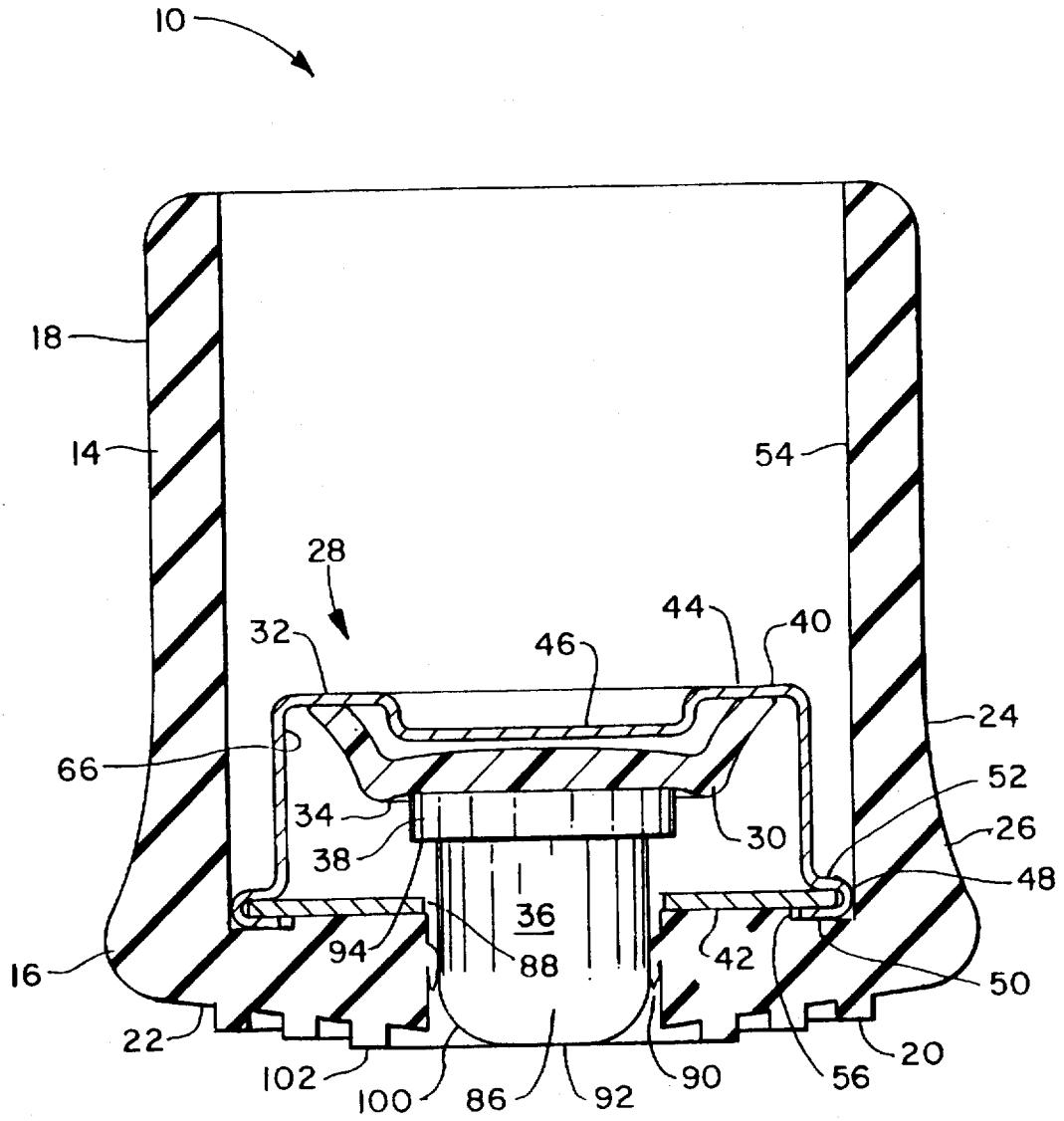
FIG. 4 is an enlarged section view of the medical walker foot of FIG. 1 showing the tip in the retracted position.

With reference to FIGS. 2, 3 and 4, a cushion assembly 28 is disposed within the shell 14. The cushion assembly 28 comprises a cushion member 30, disposed within a housing 32, which provides a bearing surface 34 for the upper pad 38 of a retractable tip member 36. The housing 32 includes an upper inverted cup-shaped can 40 and a lower washer 42 composed of rigid material, preferably metal. The upper portion 44 of the can 40 defines a circular dimple 46 that extends downwardly into the housing 32. The dimple 46 provides additional mechanical strength to the can 40 and provides a positive stop for limiting the upward movement of the pad 38 of the retractable tip member 36. The lower portion of the can 40 defines a rim 48 to which the washer 42 is mounted. As shown in FIGS. 2, 3 and 4, the can 40 may be joined to the washer 42 along a circumferential roll seam 50. The roll seam 50 preferably forms a retainer shoulder 52 which is engaged by the end of the walker leg 12 for clamping the cushion assembly 28 in place within the shell 14. Alternatively, the washer 42 may be mounted to the can 40 by a weld or other means that provides a suitably sound connection and the cushion assembly 28 may be mounted to the inside surface 54 of the shell 14. The roll seam 50 is received in a groove 56 in the inside surface 54 of the base portion 16 of the shell 14.

As shown in FIGS. 2, 3, 4 and 7, the cushion member 30 is preferably in the form of a bowl or cup, with the convex surface facing downward and the concave surface facing upward. More particularly the preferred shape is symmetric about an axis 58 with a substantially cylindrical rim portion 60 extending a distance 62 along the axis 58 and having a free end 64 for resting on the inner surface 66 of the upper portion 44 of the can 40, wherein the dimple 46 is received within the rim portion 60 of the cushion member 30. The substantially flat, solid, circular lower surface 34 acts as a pedestal bearing surface for the pad 38 of the retractable tip member 36. A side wall 68 extends between the rim portion 60 and the pedestal surface portion 34. The thickness of the rim portion 60 defines an inner diameter 70 which should be greater than the diameter 71 of the pedestal surface portion 34. The side wall 68 has an outer surface 72 which is angled obliquely toward the axis at about 45 degrees such as shown at 74, and an inner surface 76 that is angled inwardly at about 30 degrees such as shown at 78. Preferably, the height 62 of the rim 60 is at least one-half the overall height 84 of the cushion member 30. It is also preferred that the thickness of the rim portion 60 decreases slightly from the side wall 68 to the free end 64, for example by about a 2 degrees slope 80 on the outside diameter and a 2 degrees slope 82 on the inside diameter.

It should be appreciated that the cushion member 30 is a unitary piece, preferably made of urethane or similar polymeric material that is more resilient than the housing 32 and load bearing parts of the foot 10. The important feature is that the cushion member 30 resiliently deflects vertically upward when a downward force is applied to the medical walker. In the illustrated embodiment, neither the rim portion 60 nor the pedestal portion 34 experience a significant bending moment under such loading. Rather the sidewall 68 experiences the greatest stress and the resulting strain is manifested as a vertically upward deflection of the pedestal surface 34.

It should be further appreciated that the invention could also be implemented, perhaps less easily, if the cushion member 30 was oriented with the concave side facing downward and the concave side facing upward.

The retractable tip member 36 comprises an upper pad 38 and a lower stem 86 which extends downwardly through openings 88, 90 in the washer 42 and the base portion 16 of the shell 14 to a distal tip portion 92 which extends beyond the lower surface 22 of the base portion 16 when the tip member 36 is in the extended position, as shown in FIG. 3. Preferably, the tip member 36 is composed of a hard polymeric material such as nylon, wherein the distal tip portion 92 defines a rounded smooth surface which easily slides on the surface of the ground or floor. The upper pad 38 defines a shoulder 94 having a diameter D2 which is larger than the diameter D3 of the stem 86 and is also larger than the diameter D4 of the opening 88 in the washer 42, whereby the pad 38 is retained within the housing 32 of the cushion assembly 28. Preferably, the diameter D1 of the opening 90 in the base portion 16 of the shell 14 is substantially equal to the diameter D4 of the opening 88 in the washer 42 to provide support to the washer 42.

Figure 5:
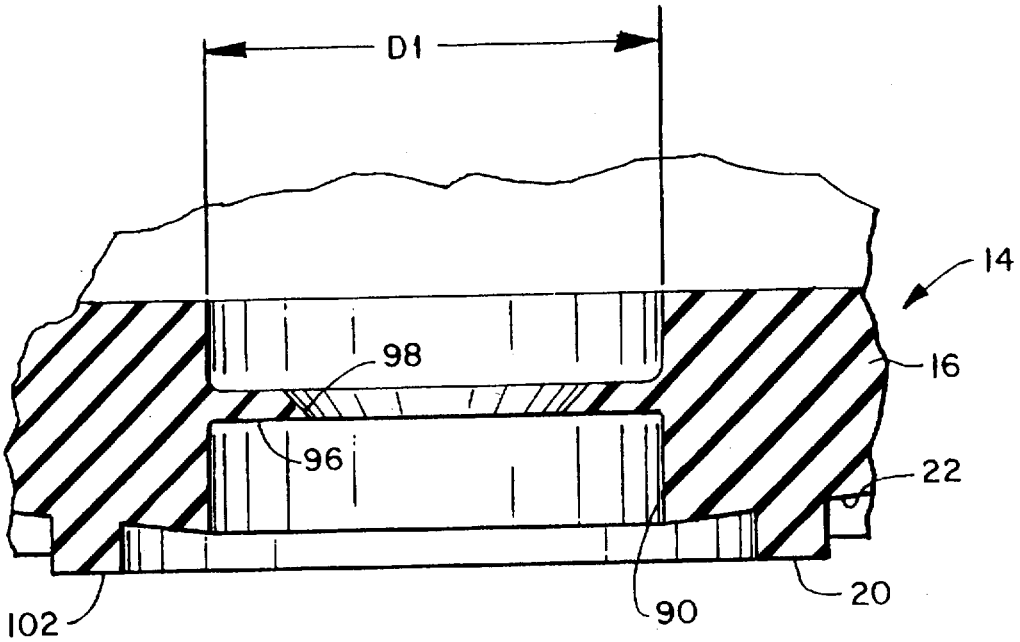
FIG. 5 is an enlarged fragmentary section view of the base portion of the shell of FIG. 1.
Figure 6:
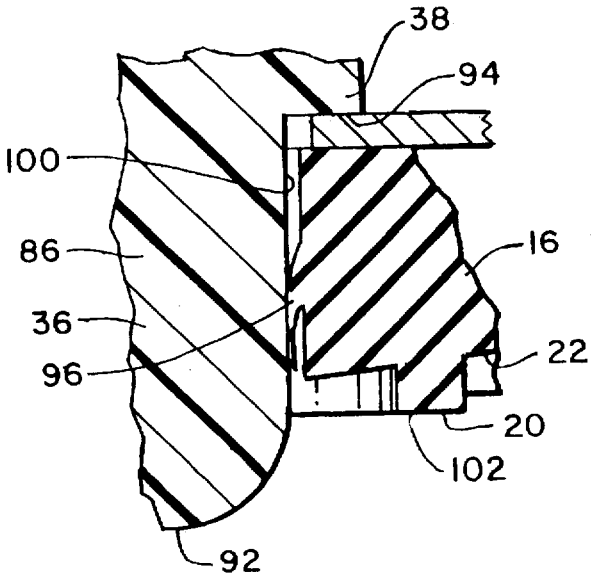
FIG. 6 is an enlarged section view of Area 2 of FIG. 3 showing the wiper seal engaged with the surface of the stem.
Figure 7:
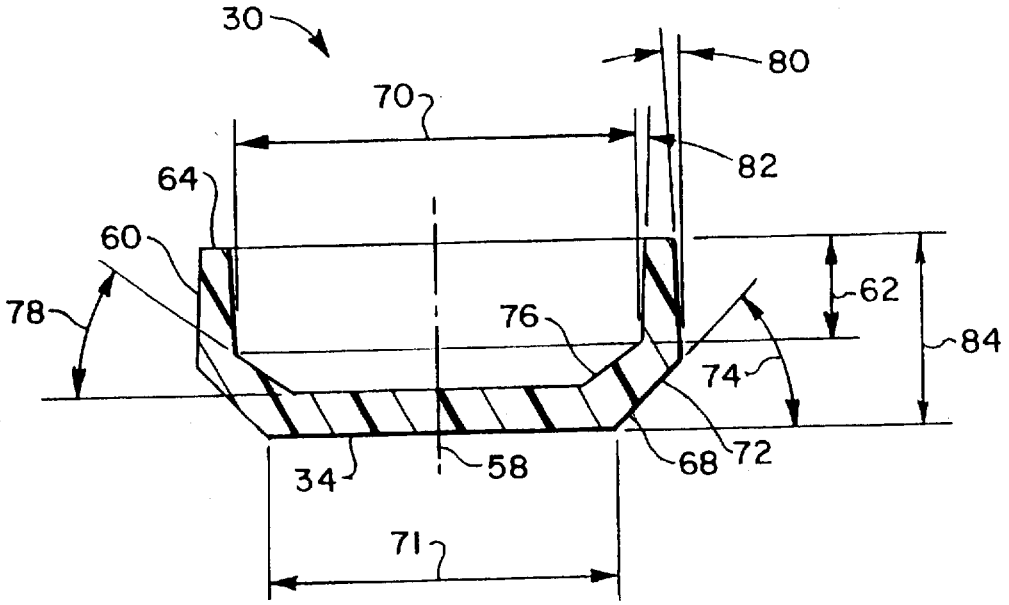
FIG. 7 is an enlarged section view of the cushion member of FIG. 3.
Figure 8:
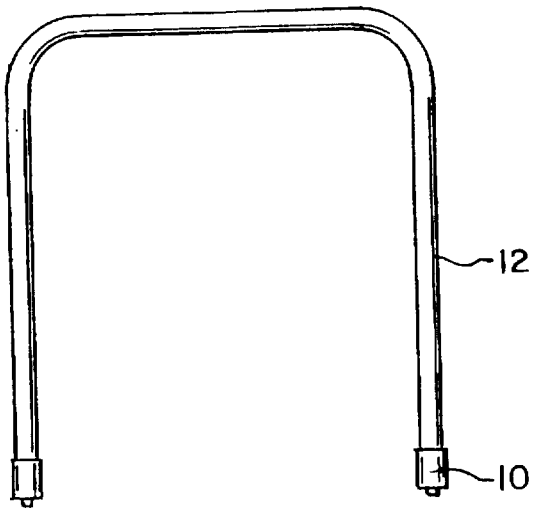
FIG. 8 is a side view of a medical walker having medical walker feet in accordance with invention.

As shown in FIGS. 5 and 6, the base portion 16 of the shell 14 includes a wiper seal 96 which extends radially into the opening 90 in the base portion 16. The inner surface 98 of the wiper seal 96 is bevelled. As shown in FIG. 6, the wiper seal 96 contacts and is flexed by the surface 100 of the stem 86 of the tip member 36 wherein the inner surface 98 of the wiper seal 96 substantially engages the surface 100 of the stem 86 to provide a seal against water infiltration. The reduced flexibility of the distal end 26 of the sleeve portion 18 ensures that shell 14 may not be flexed sufficiently that the wiper seal 96 does not engage the surface 100 of the stem 86.

The length of the distal tip portion 92 and the thickness of the sidewall portion 68 of the cushion member 30 are selected such that only six to eight (6–8) pounds of pressure is required to move the tip member 36 from the extended position shown in FIG. 3 to the retracted position shown in FIG. 4. The cushion member 30 provides a uniform six to eight pounds pressure throughout its full stroke, as opposed to conventional springs wherein the spring force generally increases as the spring is compressed. Therefore, the user does not need to place his full weight on the walker to cause the base portion 16 of the shell 14 to engage the surface of the ground or floor. In a preferred embodiment, the length of the distal tip portion 92 which extends beyond the surface of the longest rib 102 is 0.10 inches and the thickness of the sidewall portion of the cushion member 30 is 0.6 inches. Preferably, the tip member 36 partially compresses the cushion member 30 a distance of 0.012 inches when the tip member 36 is in the extended position to impose a preload on the cushion member 30. By maintaining a preload on the cushion member 30, the tip member 36 will move to the extended position without requiring that all weight be removed from the foot 10.

It should be appreciated that the spring force required to move the tip member 36 from the extended position to the retracted position and the preload on the cushion member 30 are selected such that the medical walker may be repositioned while the distal tip portion 92 maintains contact with the ground. Therefore, the medical walker may provide some degree of support even while it is being repositioned.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A grounding foot for attachment to a lower end of a medical walker leg, comprising:

shell means defining a cavity for receiving the lower end of the medical walker leg and a base for contacting the ground, said base including an exterior surface, an interior surface and an opening traversing said surfaces;

a tip member comprising a pad end and a stem extending downwardly from said pad end to a distal tip, said distal tip comprising a rounded smooth surface which is slidably moveable over a ground surface, wherein said pad end is retained in said shell while said stem is slidably disposed in said opening of said base between an extended position wherein said distal tip is proud of said exterior surface and a retracted position wherein said distal tip is disposed within said base; and biasing means disposed in said cavity for biasing said tip member to the extended position.

2. The foot of claim 1 wherein said opening of said base has a diameter D1, said pad end has a diameter D2 and said stem has a diameter D3 wherein D2>D3 and D1.

3. The foot of claim 1 wherein said biasing means comprises spring means for providing a biasing force, said spring means having first and second portions, said first portion being engaged with said pad end of said tip member, said biasing means further comprising retaining means engaged with said second portion of said spring means for retaining said spring means to the tip member while permitting the tip member to move relative to said base.

4. The foot of claim 1 wherein said biasing means comprises a resilient cushion in the form of an inverted cup defining a rim, a pedestal surface spaced from said rim and bearing on said pad end of said tip member, and a sidewall extending between said rim and said pedestal surface, said biasing means further comprising retaining means engaged with said rim of said cushion for retaining said cushion to the tip member while permitting the tip member to move relative to said base, thereby straining the cushion and deflecting said pedestal surface.

5. The foot of claim 4 wherein said retaining means comprises a rigid housing comprising a washer member disposed adjacent said interior surface of said base and a cup-shaped can member mounted to said washer member, said can member having an inside surface, said washer member defining an opening, said pad end of said tip member being disposed in said housing wherein said pad end of said tip member bears on said inside surface of said can member and said stem is slidably disposed in said opening of said washer member.

6. The foot of claim 4 wherein said cushion is a unitary piece of urethane.

7. The foot of claim 4 wherein said sidewall has a thickness which is larger near the pedestal surface than near the rim.

8. The foot of claim 5 wherein said can member comprises stop means for limiting the deflection of said pedestal surface.

9. The foot of claim 8 wherein said can member comprises an upper portion and said stop means comprises a circular protrusion extending inwardly from said upper portion, said protrusion being disposed within said rim of said cushion.

10. The foot of claim 5 wherein said washer member and said can member are joined along a roll seam, said roll seam defining a shoulder, wherein said shoulder is engageable by the lower end of the medical walker leg.

11. The foot of claim 10 wherein said interior surface of said base defines a circular groove for receiving a portion of said roll seam.

12. The foot of claim 1 wherein said shell further comprises a sleeve portion projecting upwardly from said base to a lip, said sleeve portion having an inner surface which is engageable with the lower end of the medical walker leg.

13. The foot of claim 12 wherein said sleeve portion has a thickness which is larger near the base of the shell than near the lip.

14. The foot of claim 1 wherein said tip member is composed of nylon.

15. The foot of claim 5 wherein said opening of said base has a diameter D1, said pad end has a diameter D2, said stem has a diameter D3, and said opening of said washer has a diameter D4, wherein D2>D1, D3, and D4 and D3<D1 and D4.

16. A grounding foot for attachment to a lower end of a medical walker leg, comprising:

shell means defining a cavity for receiving the lower end of the medical walker leg, said shell means comprising a base for contacting the ground and a sleeve projecting upwardly from said base, said base including an interior surface and defining an opening, said sleeve having an interior surface which is engageable with the lower end of the medical walker leg;

a tip member comprising a pad end and a stem extending downwardly from said pad end to a distal tip, wherein said pad end is retained in said shell means and said stem is slidably disposed in said opening of said base between an extended position wherein said distal tip is proud of said exterior surface and a retracted position wherein said distal tip is disposed within said base;

a resilient cushion in the form of an inverted cup defining a rim, a pedestal surface spaced from said rim and bearing on said pad end of said tip member, and a sidewall extending between said rim and said pedestal surface retaining means engaged with said rim of said cushion for retaining said cushion to the tip member while permitting the tip member to move relative to said base, thereby straining the cushion and deflecting said pedestal surface.

17. The foot of claim 16 wherein said retaining means comprises a rigid housing comprising a washer member disposed adjacent said interior surface of said base and a cup-shaped can member joined to said washer member along a roll seam, said roll seam defining a shoulder, wherein said shoulder is engageable by the lower end of the medical walker leg, said can member having an inside surface, said washer member defining an opening, said pad end of said tip member being disposed in said housing wherein said pad end of said tip member bears on said inside surface of said can member and said stem is slidably disposed in said opening of said washer member.

18. The foot of claim 17 wherein said can member includes an upper portion comprising a an inwardly extending circular protrusion, said protrusion being disposed within said rim of said cushion.

19. The foot of claim 16 wherein said interior surface of said base defines a circular groove for receiving a portion of said roll seam.

* * * * *